United States Patent [19]

Provencher

[11] 4,010,474

[45] Mar. 1, 1977

[54] TWO DIMENSIONAL ARRAY ANTENNA

[75] Inventor: Joseph H. Provencher, San Diego, Calif.

[73] Assignee: The United States of America as represented by the Secretary of the Navy, Washington, D.C.

[22] Filed: May 5, 1975

[21] Appl. No.: 574,216

[52] U.S. Cl. ..... 343/814; 343/854

[51] Int. Cl.[2] ..... H01Q 3/26

[58] Field of Search ..... 343/854, 100 SA, 814, 343/876

[56] References Cited

UNITED STATES PATENTS

| | | | |
|---|---|---|---|
| 3,295,134 | 12/1966 | Lowe | 343/854 |
| 3,400,405 | 9/1968 | Patterson | 343/854 |
| 3,868,695 | 2/1975 | Kadak | 343/854 |
| 3,940,770 | 2/1976 | Fassett et al. | 343/854 |
| 3,953,857 | 4/1976 | Jenks | 343/854 |

*Primary Examiner*—Eli Lieberman

*Attorney, Agent, or Firm*—R. S. Sciascia; G. J. Rubens; T. M. Phillips

[57] ABSTRACT

Two dimensional beam steering of an antenna array is effected by feeding a plurality of radiating elements from a hybrid matrix that is a beam forming and phasing network in combination with single pole multiple throw switches where switching the various matrix terminals give the elevation beams. Ferrite phase shifters feeding into the single pole multiple switching means provides steering of the antenna beam in the azimuth plane.

7 Claims, 6 Drawing Figures

TWO DIMENSIONAL ARRAY ANTENNA

BACKGROUND OF THE INVENTION

The effective use of high speed, high performance patrol crafts such as a hydrofoil configured high speed boat is dependent upon the performance of integrated functions within the ship. Two of these integrated functions are navigation radar and fire control radar. The requirements of the navigation radar are to provide close-in surveillance for collision avoidance of small objects or debris in the water directly in front of the boat and to provide an overall picture of all natural hazard landmarks and ships while the boat is in transit. The fire control radar should possess search and track capability and must be compatible with the IFF. The present invention provides an array antenna which can provide high agile beams to perform the required simultaneous functions to satisfy the above fire control and navigation radar requirements.

SUMMARY OF THE INVENTION

The present invention provides a two dimensional antenna array system consisting of a hybrid matrix, radiating elements, diode switches and ferrite phase shifters. The hybird matrix and diode switches provide a beam forming and phasing network to generate multiple beam positions in the elevation plane. The ferrite phase shifters provide steering in the azimuth plane. By using four planar arrays, scanning can be accomplished through 360° in azimuth. Switching of the inputs to the various matrix terminals provide scanning in the vertical dimension. The radiating elements may be simple dipoles and preferably are etched on alumina substrate. The switches and matrices may also be etched on alumina substrate to reduce weight and space requirements. Rapid beam steering is accomplished by the simultaneous switching and phase shifting.

OBJECTS OF THE INVENTION

An object of the invention is the provision of a compact and light weight two dimensional antenna array.

Another object of the invention is the provision of a two dimensional antenna beam forming system which will meet the navigation and fire control radar requirements of a fast moving patrol boat.

Other objects and many of the attendant advantages of this invention will be readily appreciated as the same becomes better understood by reference to the following detailed description when considered in connection with the accompanying drawings.

DESCRIPTION OF THE PREFERRED EMBODIMENTS

Figure 1:
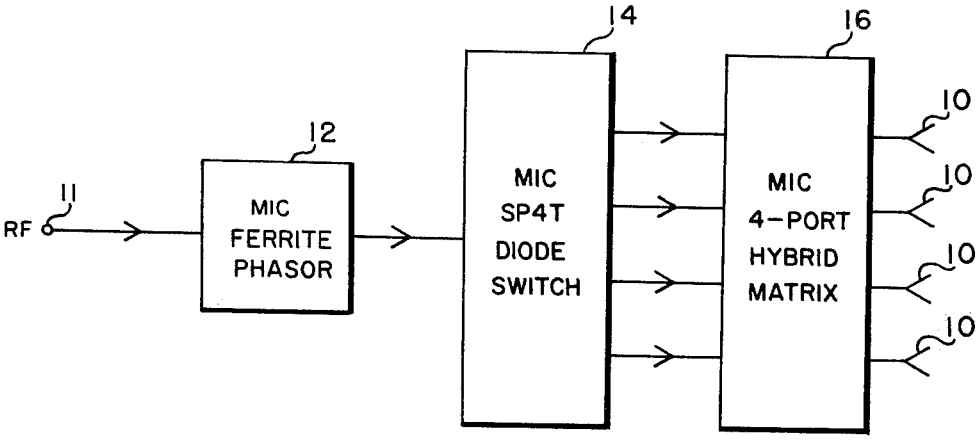
FIG. 1 is a functional diagram showing one configuration of the invention.
Figure 3:
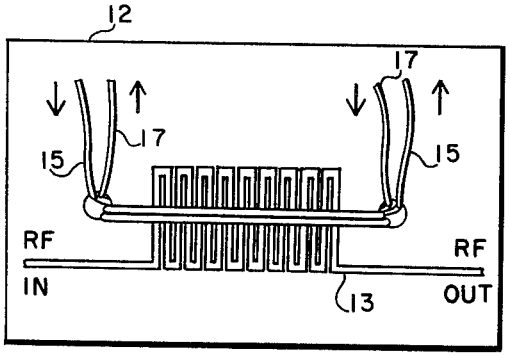
FIG. 3 shows one type of ferrite phaser for use in the embodiment of FIG. 2.

Referring now to FIG. 1 wherein there is shown an input terminal 11 for receiving an RF signal which is fed to a ferrite phasor 12. Ferrite phasor 12 is preferably of the MIC (micro integrated circuit) non-reciprocal meanderline type as shown in FIG. 3. The substrate on which the meanderline is mounted may be Yitterium Iron Garnet or Trans-Tech Inc. −390 ferrite. Since phasor 12 is an analog latching phasor, the amount of phase shift is determined by the driver signal applied to the control loops 15 and 17. The required phase shift may be supplied from the storage or calculated by the beam steering computer in a conventional manner. The phase shifted output signal from phasor 12 is fed to a single pole multiple throw diode switch 14 for switching the delayed signal to the inputs of a hybrid matrix 16. Microwave switch 14 preferably are of the type that comprise hybrid, thin film microwave diode switches characterized by 20% bandwidth at X band and consist typically of a microstrip line branching into 4 or 8 lines and shunt diodes that block the transmission paths in all but one selected direction.

Figure 5:
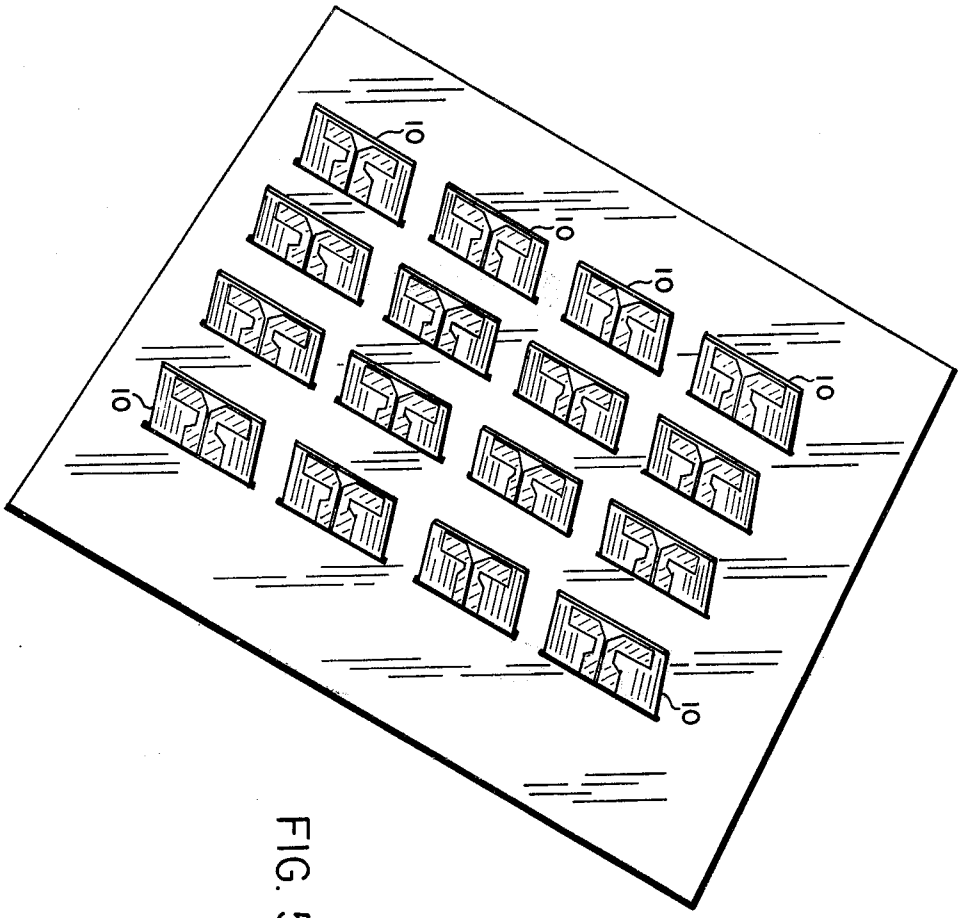
FIG. 5 shows a four dipole antenna array.

The output of hybrid matrix 16 feeds an antenna array composed of four radiating elements 10. In the embodiment shown by the block diagram of FIG. 1 a 16 antenna array as shown in FIG. 5 is envisioned and would require 16 radiating elements 10, four hybrid matrices 16, four diode switches 14 and four ferrite phasors 12. There is one diode switch 14 for each hybrid matrix 16. Each of the matrices 16 feeds one column of four radiating elements as shown in FIG. 2.

Figure 4:
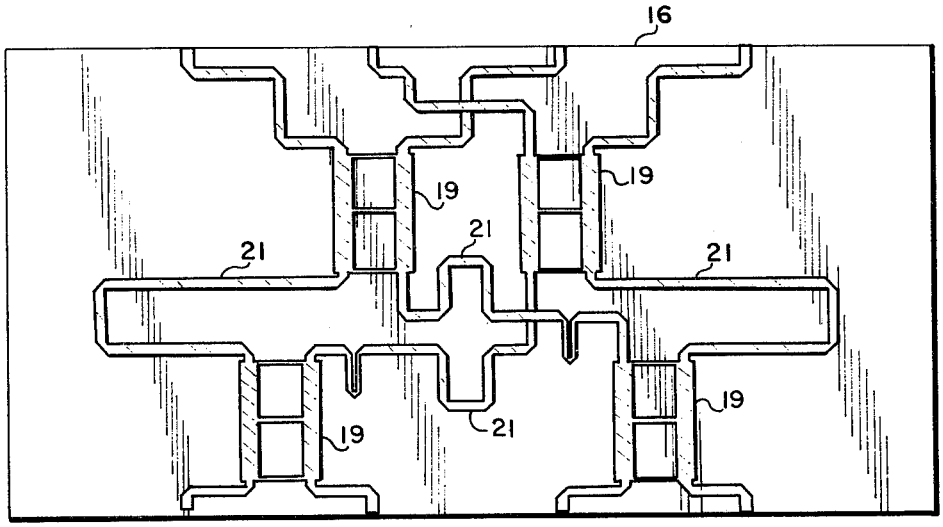
FIG. 4 shows a specific four port hybrid matrix for use in the embodiment of FIG. 2.
Figure 6:
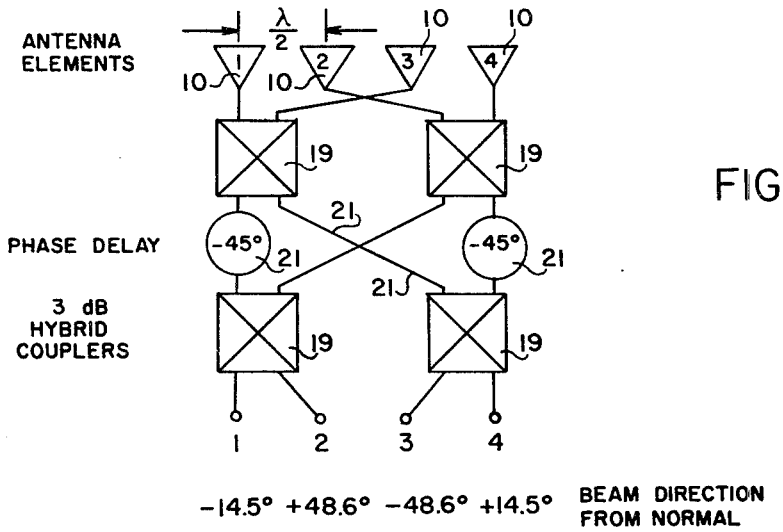
FIG. 6 is a schematic diagram of a 4-port hybride matrix coupled to one column of antennas.

A hybrid matrix is shown in FIGS. 4 and 6 and consists of 3-db quadrature couplers and constant differential phase shift lines 21. In order to improve bandwith characteristics, couplers 19 are of the 3-branch type. In order to achieve a constant differential phase shift, forty-five degree Schiffman lines 21 were used.

Figure 2:
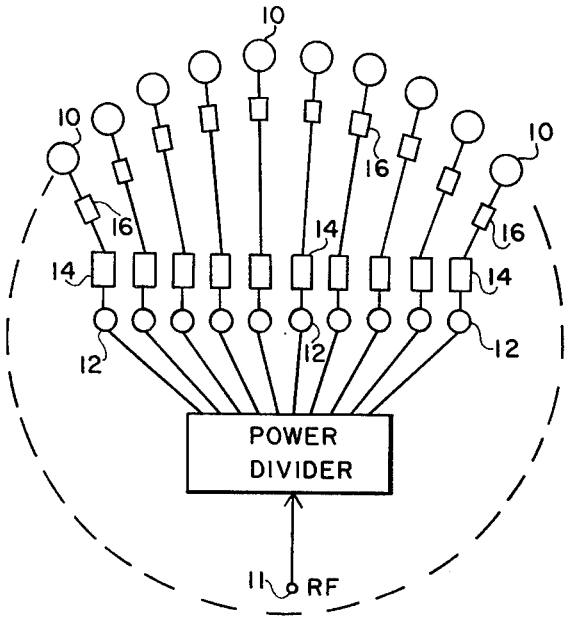
FIG. 2 is a block diagram of the two dimensional phase array antenna.

Scanning can be accomplished through 360° in azimuth using four of the planar arrays shown in FIG. 5, or by means of the circular configuration shown in FIG. 2. Radiating elements 10 are preferably of the MIC construction to allow compact design of the entire array and would be comprised of printed circuit dipoles which are fabricated on alumina substrate and which have a VSWR less than 1.5:1 from 8.5 to 9.5GHz.

As shown in FIG. 5, radiating elements 10 are positioned to form the desired number of columns and rows. In the embodiment disclosed, where four columns and four rows are shown there would be one phase shifter 12, one switch 14 and one matrix 16 for each column of antennas 10.

Obviously many modifications and variations of the present invention are possible in the light of the above teachings. It is therefore to be understood that within the scope of the appended claims the invention may be practiced otherwise than as specifically described.

What is claimed is:

1. A two dimensional antenna array system for simultaneous scanning in the azimuth and vertical comprising:

a. phase shift circuit means having an input coupled to an RF energy source and having an output, b. a plurality of radiating elements positioned to form columns and rows, c. hybrid matrix circuit means having a plurality of outputs corresponding to the number of said radiating elements, each of said plurality of outputs being connected to a corresponding one of said corresponding plurality of radiating elements, and d. switch means coupling the output of said phase shift circuit means to said hybrid circuit means whereby said RF energy is caused to be simultaneous radiated in azimuth and in elevation from said radiating elements, the number of each of said phase shift circuit means, hybrid circuit means and switch means respectively equal the number of columns formed.

2. The antenna array system of claim 1 wherein said phase shift circuit means is a micro integrated circuit ferrite phasor.

3. The antenna array system of claim 1 wherein said hybride circuit means comprises 3-db quadrature couplers, constant differential phase shift lines all of the 3-branch type.

4. The antenna array system of claim 1 wherein said switch means is a single pole multiple throw diode switch, the number of throws being equal to the number of radiating elements in a column.

5. The antenna array system of claim 1 wherein said column of radiating elements is comprised of four radiating elements and said switch means is a single pole four pole thin film, microwave diode switch.

6. The antenna array system of claim 5 wherein said hybrid matrix is four or more ports MIC hybrid matrix.

7. The antenna array system of claim 1 wherein said radiating elements comprise printed circuit dipoles which are fabricated on alumina substrate and which have a VSWR less than 1.5:1 from 8.5 to 9.5GHz.

* * * * *